US010448774B1

(12) United States Patent
Brown et al.

(10) Patent No.: US 10,448,774 B1
(45) Date of Patent: Oct. 22, 2019

(54) ARRANGEMENT FOR ADJUSTABLE SUPPORTING DUAL PANEL SHOWER CURTAIN

(71) Applicants: Daemian Brown, New York, NY (US); Jad Craig, Atlanta, GA (US)

(72) Inventors: Daemian Brown, New York, NY (US); Jad Craig, Atlanta, GA (US)

( * ) Notice: Subject to any disclaimer, the term of this patent is extended or adjusted under 35 U.S.C. 154(b) by 170 days.

(21) Appl. No.: 15/640,767

(22) Filed: Jul. 3, 2017

Related U.S. Application Data

(60) Provisional application No. 62/358,358, filed on Jul. 5, 2016.

(51) Int. Cl.
*A47H 13/00* (2006.01)
*A47K 3/38* (2006.01)
*A47H 23/00* (2006.01)

(52) U.S. Cl.
CPC ..... *A47H 13/00* (2013.01); *A47H 23/00* (2013.01); *A47K 3/38* (2013.01)

(58) Field of Classification Search
CPC ..... A47H 13/00; A47H 13/01; A47H 23/00; A47K 3/38; Y10T 24/44043; Y10T 24/4406
USPC ..... 160/89, 330, 368.1, 382–390, 400, 401, 160/402, 349.1; 135/119; 24/442, 459, 24/460, 462, 572.1, 584.1, 586.11, 591.1, 24/593.1; 16/87 R, 87.2, 87.8
See application file for complete search history.

(56) References Cited

U.S. PATENT DOCUMENTS 248,494 A * 10/1881 Mosher ..... A47C 31/04 160/402
265,688 A * 10/1882 Marsh ..... A47C 31/04 160/402
564,573 A * 7/1896 Hartshorn ..... A47C 31/04 160/402
642,236 A * 1/1900 Larimer ..... A47C 21/022 160/349.1
1,099,034 A * 6/1914 Girard ..... A47C 31/04 160/402
1,160,573 A * 11/1915 Byron ..... A47H 13/04 13/4
1,183,819 A * 5/1916 Keiser ..... B65H 75/28 24/461
1,565,576 A * 12/1925 Levy ..... E06B 9/48 160/264
1,734,769 A * 11/1929 Hadden ..... E06B 9/48 160/387
1,795,261 A * 3/1931 Murphy ..... E06B 9/48 160/238

(Continued)

*Primary Examiner* — Johnnie A. Shablack
(74) *Attorney, Agent, or Firm* — Lawrence G. Fridman, Esq; Feigin & Fridman, LLC

(57) ABSTRACT

A mounting assembly for a dual panel shower curtain formed with a female element and male element adapted for mutual cooperation. The female element is formed with a base extending between first and standing rims. An arch-shaped projection extends from the exterior surface of the base. A recess extends from an interior surface of the base. The male element is formed with a base extending between first and second flanges within a projection extending outwardly therefrom. In the assembled condition, the female element engages the male element so that the male projection is disposed within interior recess of the female element projection.

11 Claims, 4 Drawing Sheets

(56) References Cited

U.S. PATENT DOCUMENTS 2,022,807 A * 12/1935 Hagerty ..... E06B 9/46 160/396
2,093,269 A * 9/1937 Geller ..... A47H 23/08 160/124
2,247,846 A * 7/1941 Perlman ..... A47H 13/00 160/370
2,474,158 A * 6/1949 Neely ..... A47C 7/30 160/387
2,840,155 A * 6/1958 Stern ..... A47H 13/00 16/87.2
3,141,221 A * 7/1964 Faulls, Jr. ..... B65D 33/1666 206/1.5
3,142,880 A * 8/1964 Davies ..... A47C 31/04 160/402
3,161,929 A * 12/1964 Swett ..... A47K 10/12 16/87.2
3,213,926 A * 10/1965 Seckerson ..... A47H 13/00 16/87.2
3,318,224 A * 5/1967 Bohanon ..... F24F 7/065 24/462
3,338,292 A * 8/1967 Goodman ..... A47H 13/14 160/349.1
3,661,693 A * 5/1972 Pierson ..... B29C 65/565 428/123
3,700,019 A * 10/1972 Robbins ..... E04H 15/642 24/462
4,103,401 A * 8/1978 Conley ..... F16B 5/0692 24/462
4,534,089 A * 8/1985 Swan ..... B42F 1/10 24/30.5 P
4,750,243 A * 6/1988 Davis ..... A44C 7/00 24/488
4,996,752 A * 3/1991 Clendinen ..... F16B 21/06 24/464
5,003,673 A * 4/1991 Nysten ..... A44B 17/0005 24/662
5,046,695 A * 9/1991 Vuorenmaa ..... E04H 12/32 160/399
5,191,922 A * 3/1993 Wade ..... A47H 13/00 160/124
5,371,925 A * 12/1994 Sawatsky ..... B65D 33/004 24/30.5 R
5,414,950 A * 5/1995 Johnson, Sr. ..... A01M 31/025 135/119
D362,147 S * 9/1995 Voccia ..... D6/575
5,647,107 A * 7/1997 Brewster ..... G09F 7/00 24/713.6
5,651,407 A * 7/1997 Perez ..... A47H 13/00 160/330
5,752,297 A * 5/1998 Ramey ..... E04H 15/644 24/460
5,787,954 A * 8/1998 Herrera ..... A47K 3/38 16/87.2
5,862,850 A * 1/1999 Yang ..... E06B 9/262 160/264
5,894,642 A * 4/1999 Eberhardt ..... A47H 13/16 160/124
5,903,957 A * 5/1999 Le Manchec ..... A47H 13/01 16/87.2
6,041,454 A * 3/2000 Summerford ..... A47H 13/00 160/330
6,163,899 A * 12/2000 Leonard ..... A47H 23/06 160/330
6,189,597 B1 * 2/2001 Cheng ..... A47H 13/02 160/330
6,223,389 B1 * 5/2001 Walsh ..... A47H 13/00 16/87.2
6,308,387 B1 * 10/2001 Borzi ..... A47H 13/00 16/87.2
7,721,396 B2 * 5/2010 Fleischman ..... A47C 1/14 24/303
8,297,335 B2 * 10/2012 Bennett ..... A47H 2/00 160/330
8,910,697 B1 * 12/2014 Dollahan Shirk ..... A47H 13/06 160/178.1 V
8,911,171 B2 * 12/2014 Kotaki ..... B60N 2/7041 24/462
9,107,544 B2 * 8/2015 Cittadino ..... A47H 13/02
D788,325 S * 5/2017 Laurence ..... D25/57
D809,822 S * 2/2018 Brown ..... D6/575
10,167,886 B2 * 1/2019 Stone ..... F16B 5/0692
2002/0088098 A1 * 7/2002 Bouley ..... B42B 5/02 24/464
2003/0154579 A1 * 8/2003 Disher ..... B43M 99/001 24/462
2007/0215296 A1 * 9/2007 Voutour ..... A47H 13/00 160/330
2008/0229491 A1 * 9/2008 Gregory ..... A47K 3/38 4/558
2009/0272502 A1 * 11/2009 Brown ..... A47K 3/38 160/330
2010/0193655 A1 * 8/2010 Fleischman ..... A47C 1/14 248/316.7
2010/0282420 A1 * 11/2010 Lai ..... A47H 13/02 160/330
2011/0044753 A1 * 2/2011 Kotaki ..... B60N 2/7041 403/235
2013/0009443 A1 * 1/2013 Kotaki ..... B60N 2/7041 297/463.1
2017/0086616 A1 * 3/2017 Hickey ..... A47H 23/00

* cited by examiner

ARRANGEMENT FOR ADJUSTABLE SUPPORTING DUAL PANEL SHOWER CURTAIN

CROSS-REFERENCE TO RELATED APPLICATION

The present application claims priority of Provisional Patent Application Ser. No. 62/358,358 filed by the Applicants on Jul. 5, 2016, the entire disclosure of which is hereby incorporated by reference.

FIELD OF THE INVENTION

The present invention relates to devices for supporting shower curtains in general, and more particularly to an arrangement for adjustable supporting a dual panel shower curtain.

BACKGROUND OF THE INVENTION

It is known in the art to use two separate sets of devices or hooks to support dual panel shower curtains or a shower curtain—shower curtain liner combination on a horizontal rod mounted in a shower enclosure, over a bathtub or the like. However, utilizing two sets of devices for that purpose requires that both sets of devices or hooks be supported on the same rod. This causes crowding and interference between the hooks as the curtain and liner are drawn along the rod. Moreover, utilizing two sets of devices or hooks is wasteful and expensive. Furthermore, it is time consuming and complicated to install the curtain and liner when separate sets of devises are employed. It is therefore desirable to utilize a set of single support structures suspended from a horizontal rod to support both the shower curtain and the shower curtain liner simultaneously.

Accordingly, it has been a long felt and unsolved need for a simple and effective accessory/arrangement for simultaneous attaching the shower curtain and the shower curtain liner to a rod while maintaining an aesthetic appearance. It has been also a need for a simple, economical, and effective accessory/arrangement for simultaneous attaching the shower curtain and the shower curtain liner to a rod. There is also a further need for a shower curtain accessory which can be installed by a common user in a simple and effortless manner with little or no training and does not require tools for installation.

To overcome drawbacks of the prior art, the invention provides a simple and effective accessory/arrangement for simultaneous attaching a shower curtain and a shower curtain liner to a rod while maintaining an aesthetic appearance. The shower curtain accessory including the mounting arrangement of the invention can be utilized by a common user in a simple and effortless manner with little or no training and does not require tools for installation.

SUMMARY OF THE INVENTION

As used herein, the terms "rod" or "rod-like" refers to an elongated object which can have a varying cross section, but preferably a uniform cross section and can be solid or hollow. More preferably, the cross section is circular. The rod can be made of wood, metal, plastic, a combination of any of the foregoing, or any other suitable material for supporting the accessory according to the invention.

As used herein, the term "sheet of material" broadly refers to a piece of material having relatively large dimensions in the directions of height and length as compared to its width. The sheet of material can be made of any substance consistent with the scope of the invention. The invention relates to an accessory adapted for adjustable mounting a dual panel shower curtain onto a rod-like member.

As used herein, the term "resilient" is used in its ordinary meaning to refer to a tendency of an object to return to its original shape after deformation. The resilient material can be made of a plastic, or similar items or a combination thereof, or any other suitable material constructed and shaped to achieve the goal of being resilient for the practice of the invention.

For purposes of this description, the terms "upper," "bottom," "right," "left," "front," "vertical," "horizontal," and derivatives thereof shall relate to the invention as oriented in figures of the drawing.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

BRIEF DESCRIPTION OF THE DRAWINGS

Referring now to the drawings which are provided to illustrate and not to limit the invention, wherein.

DETAILED DESCRIPTION OF THE INVENTION

Figure 1:
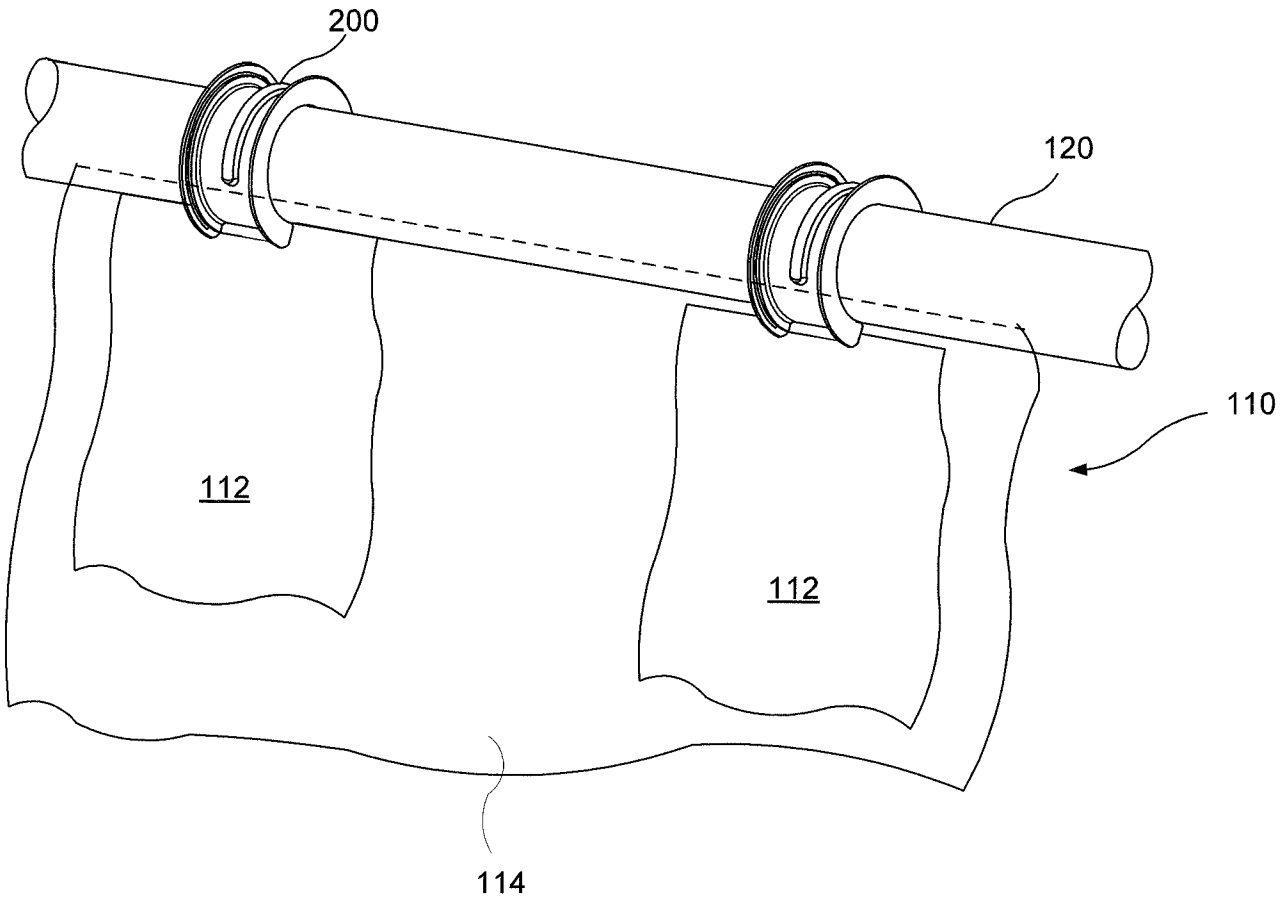
FIG. 1 is a schematic diagram illustrating positioning of the shower curtain/shower liner of the invention on a support rod.
Figure 4:
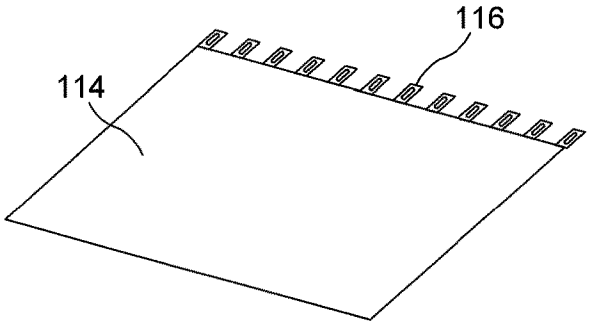
FIG. 4 is a schematic view of a shower liner.
Figure 3:
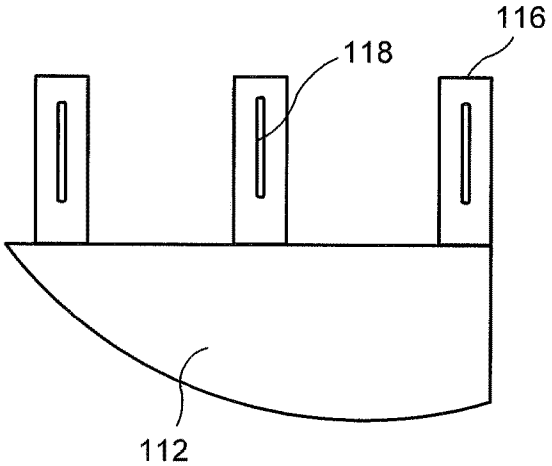
FIG. 3 is an enlarged view of a detail of FIG. 4 showing a connecting element.
Figure 2:
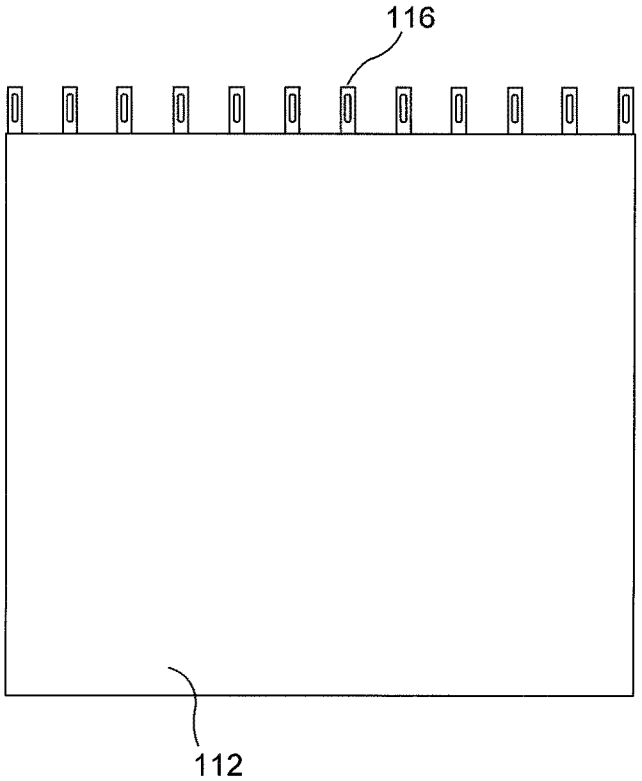
FIG. 2 is an elevational view of a shower curtain.

We are referring now to the drawings in general and to FIGS. 1-4 in particular, illustrating a shower curtain—a shower curtain liner combination or a dual panel shower curtain, which is adjustably positioned on a conventional shower curtain rod via multiple mounting assemblies that slide on the rod. It will be discussed below that the above beneficially occurs without intervening conventional shower curtain rings, hooks, etc.

We are referring now to FIG. 1 illustrating positioning of the dual panel shower curtain of the invention on a support rod. As further illustrated in FIGS. 2-4, the dual panel shower curtain 110 typically comprises an outer panel or shower curtain 112 connected to an inner panel or curtain liner 114 by a plurality of connecting elements 116. The outer panel 112 comprises an upper portion, a lower portion and side portions. In a similar manner, the inner panel 114 comprises an upper portion, a lower portion and side portions. The top portions are not attached to each other, the side portions are not attached to each other, the bottom portions are not attached to each other. The upper portions of the outer panel 112 and the inner panel 114 are attached to each other by multiple connecting elements 116 combining both panels in one unit. On the other hand, in another embodiment of the invention each panel can be formed with its own connecting elements 116, whereas in the assembled condition these two sets of the connecting elements are joined by the respective mounting assemblies, as discussed later in the application. The connecting elements 116 are attached to the respective panels in any conventional way including adhesive, fastener strips snaps, stitches, welds, e.g., friction welds, heat welds, high frequency welds, laser welds, radio frequency welds, ultrasonic welds, vibration welds, and so forth.

It will be discussed below that the upper portion of the outer panel 112 and the inner panel 114 of the dual panel shower curtain 110 are joined together by the connecting elements 116 via a plurality of mounting assemblies 200, which are spaced longitudinally from each other in a conventional manner.

Figure 5:
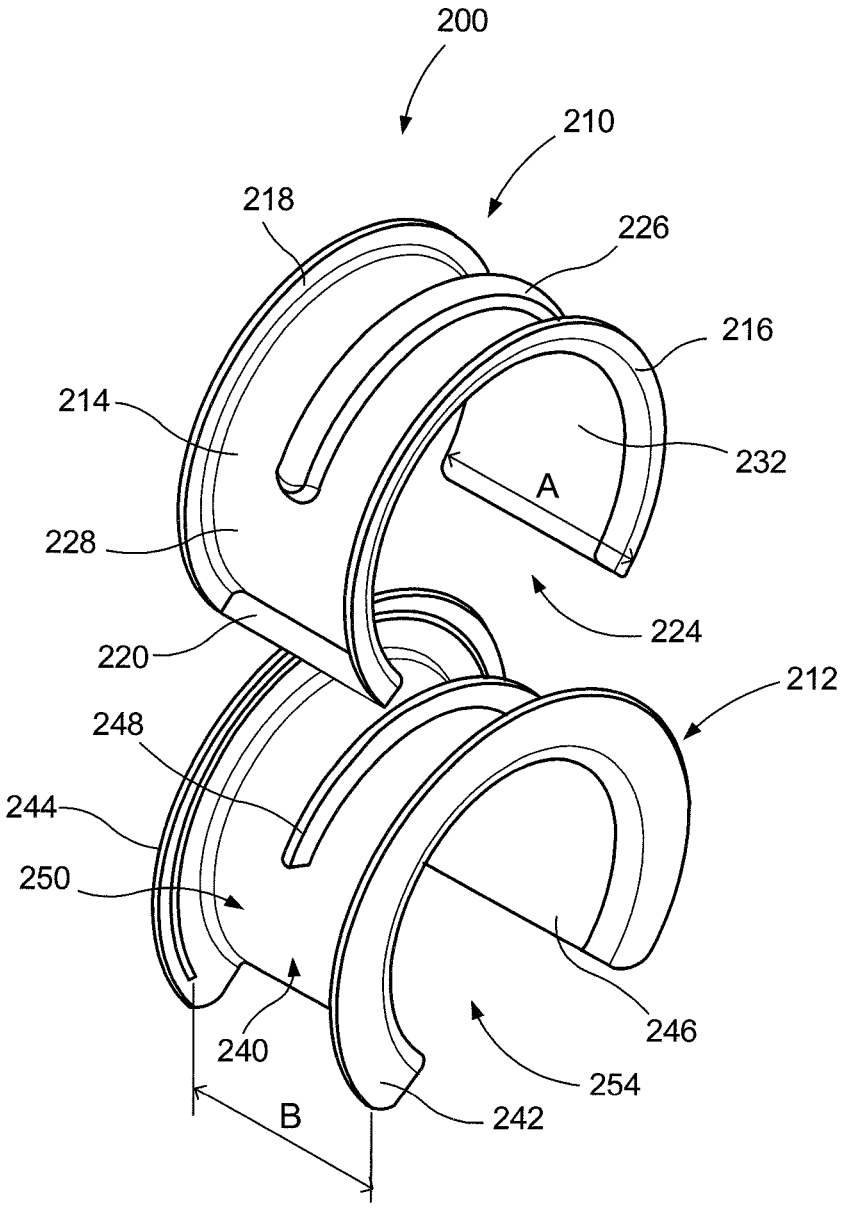
FIG. 5 is an exploded view showing male and female elements of the mounting assembly.
Figure 7:
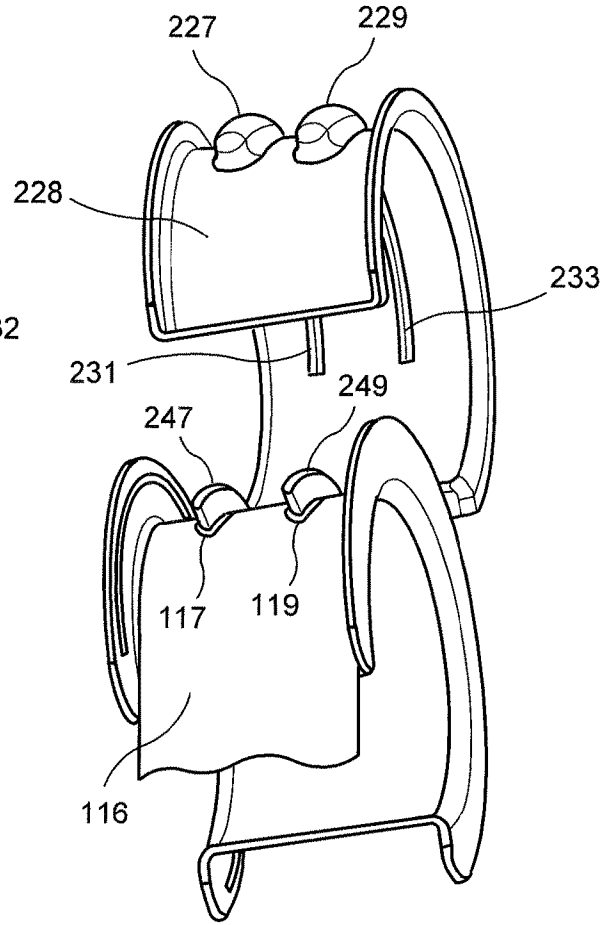
FIG. 7 is a perspective exploded view of another embodiment of the mounting assembly.
Figure 6:
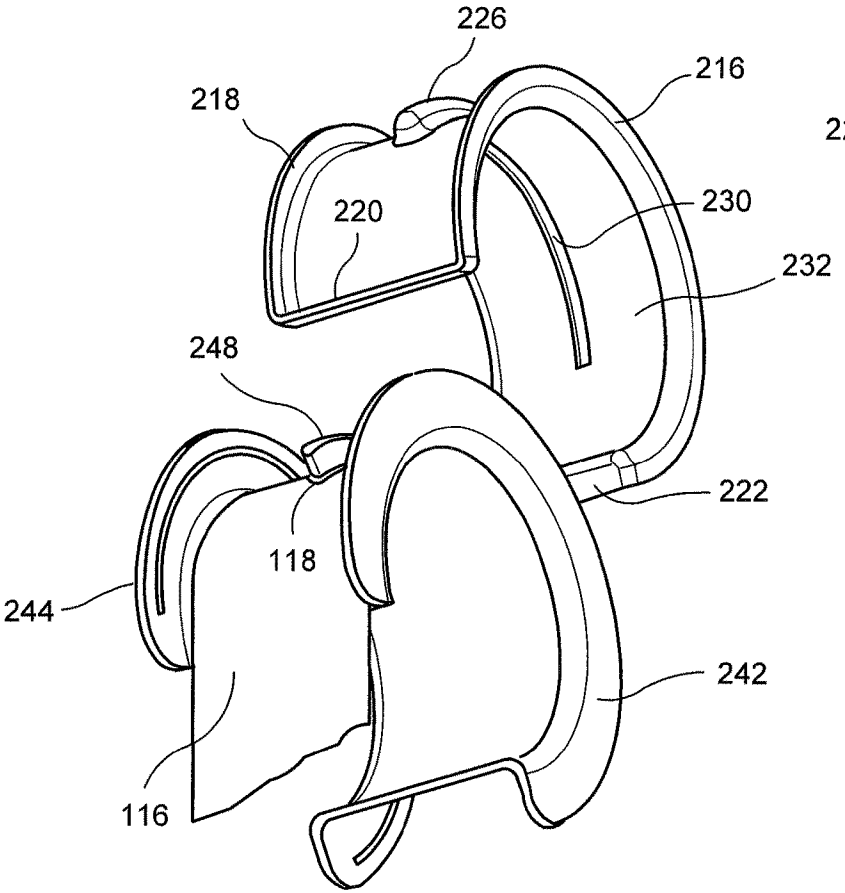
FIG. 6 is another perspective exploded view of the mounting assembly.

We are referring now to FIGS. 5-7 illustrating the shower curtain accessory which includes multiple mounting assemblies 200 to support a shower curtain-shower curtain liner combination 110 on a substantially horizontal rod 120 mounted in a shower enclosure over the bathtub or the like.

The mounting assembly 200 is adapted to engage the shower curtain rod 120 of a conventional design in order to simultaneously support the shower curtain 112 and the shower curtain liner 114 in a side by side spaced relation within a shower enclosure or the like. Each mounting assembly 200 consists of a female element 210 and a male element 212 adapted for mutual cooperation. The female element 210 is formed by a semi-cylindrical base 214 extending between first 216 and second rims 218. Longitudinally extending stoppers 220, 222 are provided at each end of the element 210. At a lower region, an operational open space 224 is formed between the stoppers for the insertion of the male element. An arch-shaped projection 226 extends outwardly from a central area of an exterior surface 228 of the semi-cylindrical base. A recess 230 extending inwardly from an interior surface 232 of the base is provided within the projection 226. It will be discussed below that in the assembled condition the interior recess 230 accommodates/receives a projection 248 of the male element 212.

The male element 212 is formed by a semi-cylindrical base 240 extending between first 242 and second 244 flanges. In the preferred embodiment of the invention, an interior area 246 of the male element 212 is substantially cylindrical, so as to accommodate slidable motion of the mounting assembly 200 along the support shower curtain rod 120. An arch-shaped projection 248 extends outwardly from a central area of an exterior surface 250 of the semi-cylindrical base 240. In the circumferential direction, the ends of the base and the flanges are separated by a gap 254, so as to facilitate positioning of the male element on the support rod A. In the assembled condition, the female element 210 engages the male element 212, so that the exterior surface 250 of the male element base 240 substantially engages the interior surface 232 of the female element base. In this condition, the male projection 248 is disposed within the interior recess 230 of the female element. Since the distance A between exterior surfaces of the first and second rims 216,218 is slightly smaller than the distance B between the interior surfaces of the first and second flanges 242,244 of the male element, in the assembled condition, the exterior surfaces of the first 216 and second rims 218 are disposed in a close vicinity of the interior surfaces of the respective flanges 242, 244 of the male element. In view of the resiliency of material used in manufacturing of the mounting assembly, upon insertion the female element 210 snaps on the male element 212 so that the mounting assembly is locked.

Although, in the preferred embodiment of the mounting assembly, the interior of the male element is substantially cylindrical to accommodate its slidable motion on the cylindrical supporting rod, other shapes of the interior surface of the male element provided to accommodate different shapes of the supporting rod are within the scope of the invention.

The shower curtain 112 and the shower curtain liner 114 are interconnected by a plurality of connecting members 116, each formed with a slot 118 provided to accommodate the projection 248 of the respective male element. During the assembly process, the respective connecting member 116 is initially disposed within a receiving space 252 having the width substantially equal to the distance B defined between the interior surfaces of the first 242 and second 244 flanges. In this position the projection 248 of the male element is disposed within and extends above the slot 118 of the connecting member. Then, the female element is positioned over the male element, so that the male projection 248 is inserted into the inner recess 230 of the female projection locking the connecting member 116 between the outer surface 250 of the male base and the inner surface 232 of the female base, preventing disengagement of the connecting member from the mounting assembly.

FIG. 7 illustrates the embodiment of the invention with multiple arch-shaped projection 227 and 229 extending outwardly from the exterior surface 228 of the female element. Two recesses 231 and 233 extending inwardly from an interior surface 232 of the base are provided within the projections 227 and 229. Similarly, two projections 247 and 249 extend outwardly from the exterior surface 250 of the male element. In the assembled condition, the projections 247, 249 engage the recesses 231,233. To accommodate the embodiment of FIG. 7, the connecting elements 116 are formed with double slots 117 and 1119. In use, a plurality of mounting assemblies 200 supporting the respective connecting members 116 as well the shower curtain 112 and the shower curtain liner 114, in accordance with the present invention are suspended at spaced intervals along shower curtain rod 120.

The female element 210 and the male element 212 are typically integrally formed or molded of a deformable plastic during the assembly. The plastic is sufficiently resilient to return to the undeformed state after the elements are locked upon each other. Suitable plastic having the desired elasticity and resiliency, and being sufficiently rigid is polypropylene, polyvinyl chloride, etc. Other moldable plastics such as polyvinyl chloride colpolymers maybe used as well. The dual panel shower curtain is constructed of conventional shower curtain material, e.g., polyvinyl chloride ("PVC"), ethylene vinyl acetate ("EVA"), polyethylene vinyl acetate ("PEVA"), natural or synthetic fabrics or similar shower curtain material. The term plastic has been used herein to indicate the fact that a variety of materials such as natural or synthetic elastic and resilient plastic like materials can be utilized.

The advantage of using relatively inexpensive materials such as various plastics is that the mounting assemblies 200 and the entire shower curtain accessory of the invention can be manufactured at a price enabling the shower curtain and the shower curtain liner combination to be sold as a disposable unit. A disposable shower curtain—shower curtain liner not only provides convenience of modem life, but also could be used in many commercial situations such as hotels and resorts and could also be used in institutional environments.

It will now be appreciated that the present invention provides an arrangement for simultaneously supporting a shower curtain and a shower curtain liner in side to side spaced, parallel relation from a curtain rod. It should be also appreciated that the invention provides a simple and effective arrangement for simultaneous attaching the shower curtain and the shower curtain liner to a rod while maintaining an aesthetic appearance. The mounting arrangement of the invention can be utilized by a common user in a simple and effortless manner with little or no training and does not require tools for installation.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

What is claimed is:

1. A dual panel shower curtain comprising: an inner panel having a top edge, a bottom edge and side edges; an outer panel having a top edge, a bottom edge and side edges; at least two connecting members each having a slot, and each said connecting member joining together an upper portion of the inner panel and an upper portion of the outer panel; and at least two mounting assemblies for attaching the dual panel shower curtain directly to a shower curtain rod;

each said mounting assembly consists of a female element and a male element adapted for mutual cooperation in such a manner that said connecting member is interposed between said female and male elements;

said female element formed by a semi-cylindrical base having exterior and interior surfaces and extending longitudinally between spaced from each other first and second rims in one direction and first and second ends in another direction, an operational space is formed between the ends of the female element, at least one arch-shape projection extends outwardly from a central area of an exterior surface of the semi-cylindrical base, at least one recess provided at an interior surface of the base extends into said at least one projection;

said male element formed by a semi-cylindrical base having inner and outer surfaces, the male element extends between spaced from each other first and second flanges in one direction, and between first and second ends in another direction, the ends of the base and flanges are separated by a gap, at least one male projection extends outwardly from the outer surface of the base, and wherein in an assembled condition the female element engages the male element such that the exterior surface of the male element base substantially engages the interior surface of the female element base with said at least one male projection being received within the interior recess of said at least one female element projection, and the ends of the base and the flanges are separated by the gap to facilitate positioning of the male element on a support rod.

2. The dual panel shower curtain according to claim 1, wherein in the assembled condition of said mounting assembly, the female element engages the male element so that the exterior surface of the male element base substantially engages the interior surface of the female element base, so that the male projection is disposed within the interior recess of the female element projection.

3. The dual panel shower curtain according to claim 2, wherein the distance between exterior surfaces of the first and second rims are slightly shorter than the distance between the interior surfaces of the first and second flanges of the male element.

4. The dual panel shower curtain according to claim 3, wherein in the assembled condition of the mounting assembly arrangement, the exterior surfaces of the first and second rims face the interior surfaces of the respective flanges of the male element.

5. The dual panel shower curtain according to claim 4, wherein the connecting member is disposed within a space defined between the interior surfaces of the first and second flanges, so that the projection of the male element is positioned within the slot of the connecting member.

6. The dual panel shower curtain according to claim 5, wherein the female element is positioned over the male element so that the male projection is positioned within the inner recess of the female projection locking the connecting member between the outer surface of the male base and the inner surface of the female base preventing disengagement of the connecting member from the mounting assembly.

7. The dual panel shower curtain according to claim 1, wherein said at least two mounting assemblies are a plurality of the mounting assemblies.

8. A mounting assembly for a dual panel shower curtain comprising:

a female element and a male element provided from mutual cooperation, said female element formed by a semi-cylindrical base having exterior and interior surfaces and extending longitudinally between spaced from each other first and second rims in one direction and first and second ends in another direction, an operational space is formed between the ends of the female element, at least one arch-shape projection extends outwardly from a central area of an exterior surface of the semi-cylindrical base, at least one recess provided at an interior surface of the base extends into said at least one projection; and a male element formed by a semi-cylindrical base having inner and outer surfaces, the male element extends between spaced from each other first and second flanges in one direction, and between first and second ends in another direction, the ends of the base and flanges are separated by a gap, at least one male projection extends outwardly from the outer surface of the base;

wherein in an assembled condition the female element engages the male element such that the exterior surface of the male element base substantially engages the interior surface of the female element base with said at least one male projection being received within the interior recess of said at least one female element projection.

9. The mounting assembly for the dual panel shower curtain according to claim 8, wherein the distance between exterior surfaces of the first and second rims of the female element is slightly shorter than the distance between the interior surfaces of the first and second flanges of the male element, so that in the assembled condition the exterior surface of the first and second rims are disposed in a close vicinity of the interior surface of the respective flanges of the male element.

10. The mounting assembly according to claim 9, wherein the female element is positioned over the male element so that the male projection is disposed within the inner recess of the female projection locking the connecting member between the outer surfaces of the male base and the inner surface of the female base preventing disengagement of the connecting member from the mounting assembly.

11. The mounting assembly according to claim 8, wherein said at least one female recess projection comprises at least two female recesses and said at least one male projection comprises at least two projections.

* * * * *